United States Patent [19]

Miller et al.

[11] Patent Number: 5,040,468

[45] **Date of Patent: * Aug. 20, 1991**

[54] DOOR MOUNTED IRONING BOARD ASSEMBLY

[75] Inventors: Benson L. Miller; Paul T. Scherer, both of Lexington; Neiman C. Maclin, Louisville, all of Ky.

[73] Assignee: Millex, Inc., Lexington, Ky.

[ * ] Notice: The portion of the term of this patent subsequent to Feb. 13, 2007 has been disclaimed.

[21] Appl. No.: 573,375

[22] Filed: Aug. 24, 1990

Related U.S. Application Data

[63] Continuation of Ser. No. 389,878, Aug. 4, 1989, Pat. No. 4,976,205, and a continuation of Ser. No. 98,558, Sep. 21, 1987, Pat. No. 4,899,667.

[51] Int. Cl.[5] ..... A47B 5/00

[52] U.S. Cl. ..... 108/47; 108/134; 248/206.3

[58] Field of Search ..... 108/47, 48, 42; 312/245, 310, 313, 315; 38/103, 104, 112, 106; 248/215, 214, 206.3, 301, 211, 339, 206.1

[56] References Cited

U.S. PATENT DOCUMENTS

| | | | |
|---|---|---|---|
| 920,343 | 5/1909 | Kelly et al. | 108/135 X |
| 1,843,391 | 2/1932 | Gayle | 108/47 X |
| 2,867,401 | 1/1959 | Shoahan | 108/47 X |
| 4,657,249 | 4/1987 | Offutt | 248/206.1 X |
| 4,862,611 | 9/1989 | Wright | 108/48 X |
| 4,899,667 | 2/1990 | Miller et al. | 108/134 X |
| 4,961,388 | 10/1990 | Simpson | 108/134 X |
| 4,976,205 | 12/1990 | Miller et al. | 108/134 X |

FOREIGN PATENT DOCUMENTS

| | | | |
|---|---|---|---|
| 0199814 | 3/1958 | Austria | 108/135 |
| 370129 | 4/1932 | United Kingdom | 108/135 |
| 053043 | 11/1960 | United Kingdom | 108/134 |
| 293132 | 7/1978 | United Kingdom | 297/256 |

*Primary Examiner*—José V. Chen

*Attorney, Agent, or Firm*—King and Schickli

[57] ABSTRACT

An ironing board assembly for mounting on a standard door in the home or the like includes a tubular mounting frame, a pivoted ironing board on the frame and, if desired, a swinging cover for enclosing the board and frame when not in use. The frame is supported by at least one hanger bracket adapted to extend over the top of the door. The bracket includes an inverted U-shaped hook and a second hook extending in the opposite direction. A coupler section in between provides a small included angle of approximately 6° between the hooks for pre-biasing the assembly so as to maintain it snug against the door. A bent prong rotatably fixes the second hook to the frame. The ironing board is supported in the horizontal operative position by a U-shaped support brace. One of the pivot pins mounting the brace is flexible and engages a tab with a cam portion forming a detent providing snap action retention when the board is raised. A plastic stop absorbs shock as the board moves to the operative position. Hinges supporting the auxiliary swinging cover include a mounting block and a hinge rod; the block serving as a spacer for the frame against the door. Suction cups mounted on the frame lock onto the door.

6 Claims, 3 Drawing Sheets

FIG. 1A
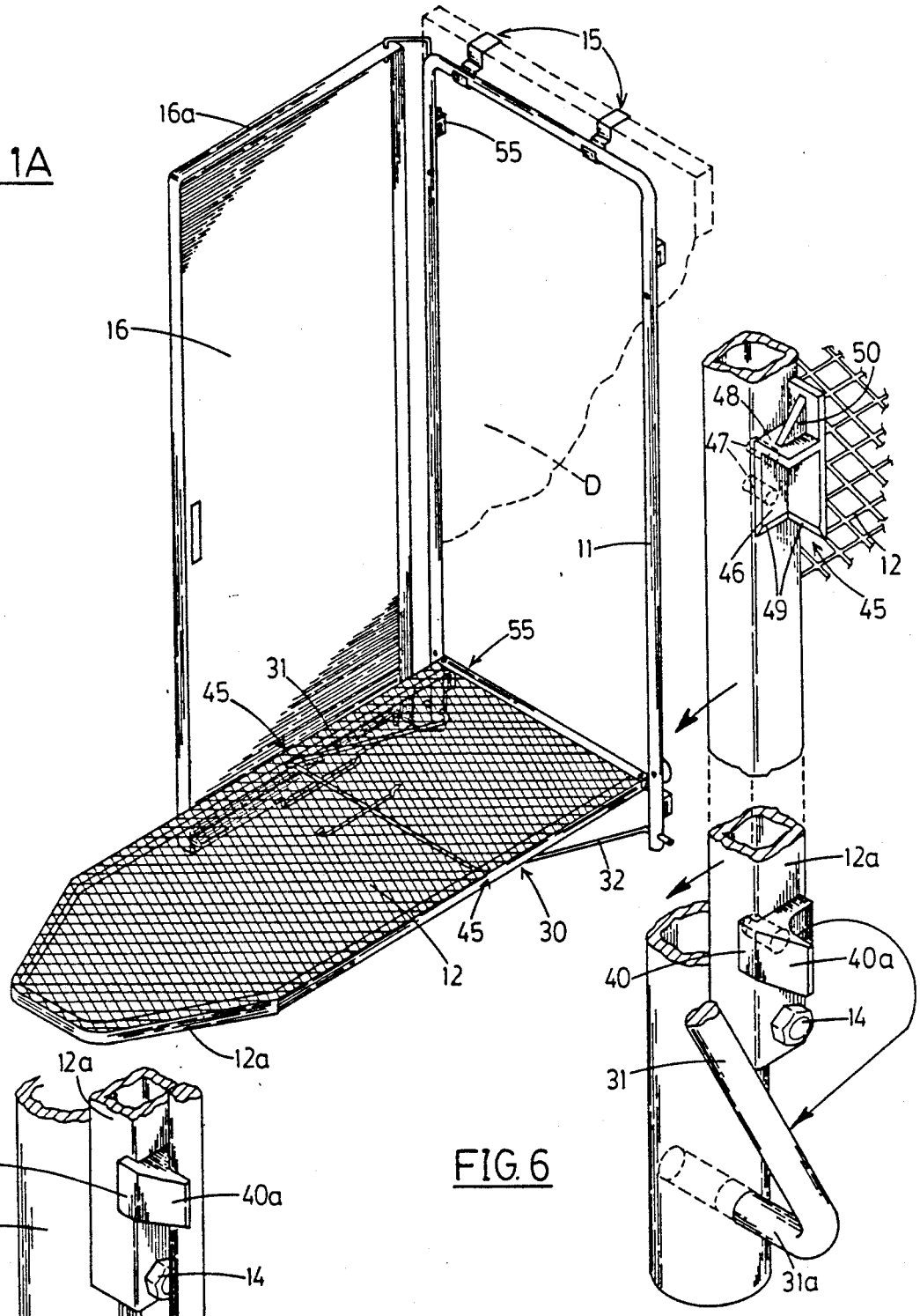
FIG. 6
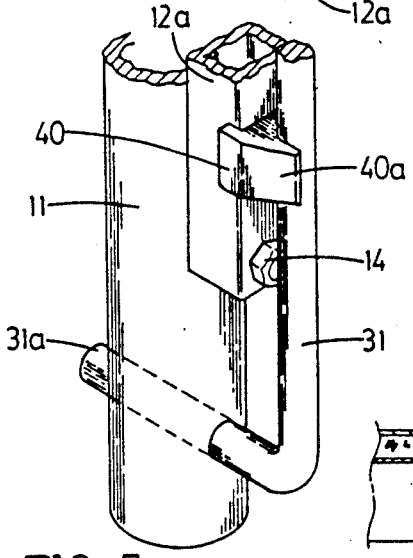
FIG. 5
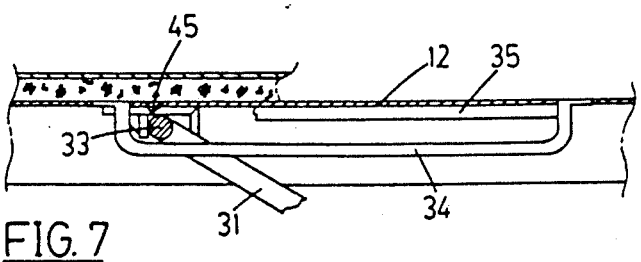
FIG. 7

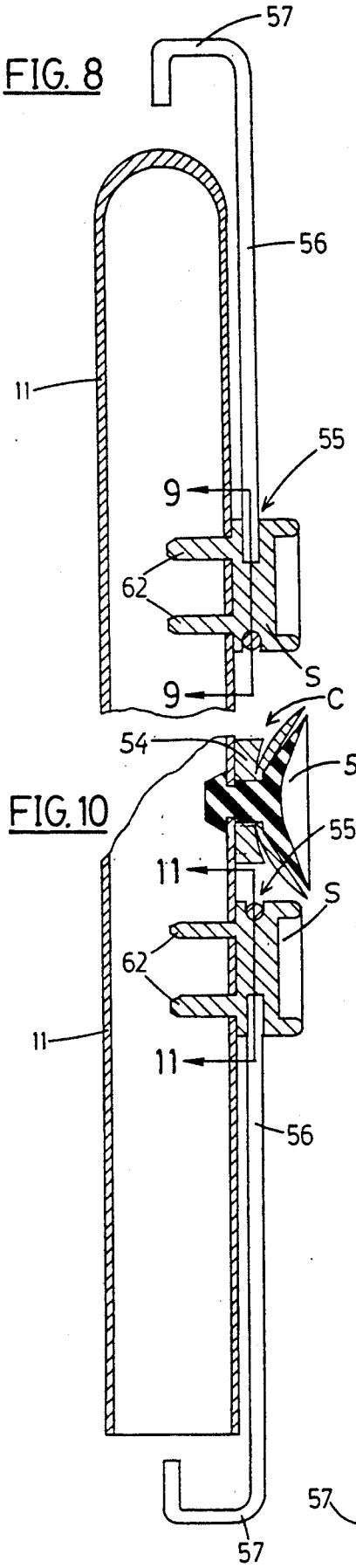
FIG. 8
FIG. 10
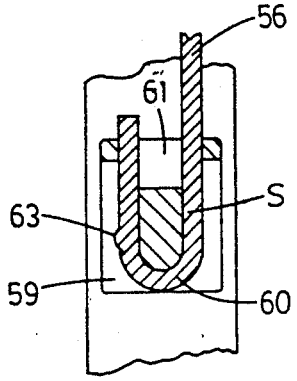
FIG. 9
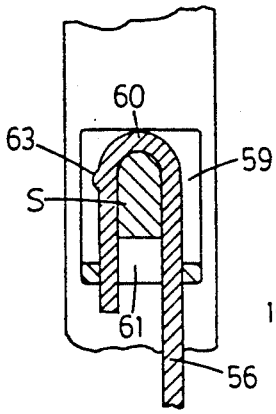
FIG. 11
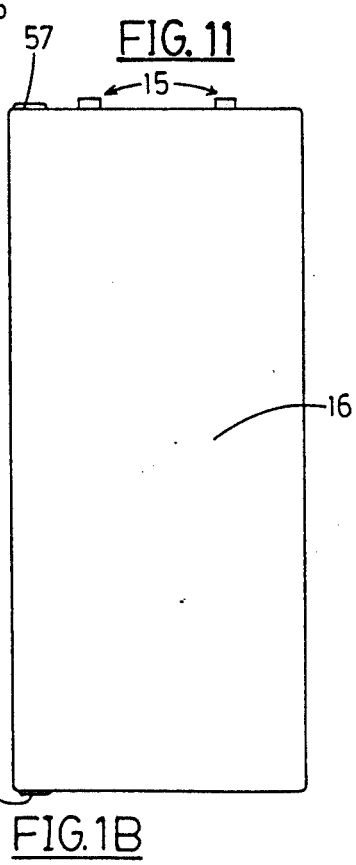
FIG. 1B
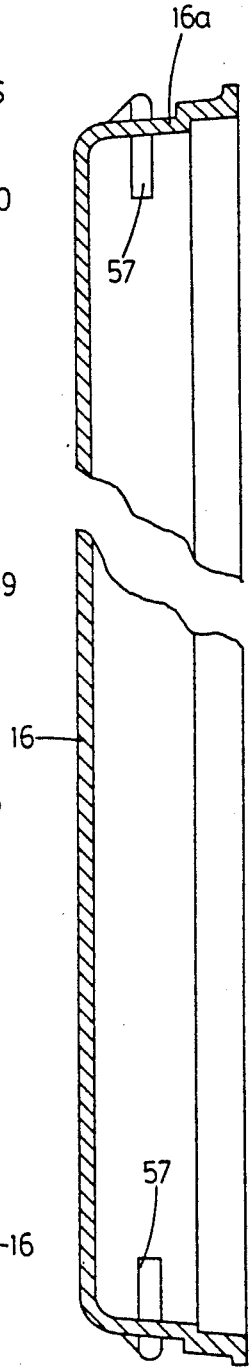
FIG. 12

DOOR MOUNTED IRONING BOARD ASSEMBLY

The parent U.S. patent applications, Ser. Nos. 098,558, filed Sept. 21, 1987 and 389,878, filed Aug. 4, 1989, of which the present application is a continuation of both, are now U.S. Pat. No. 4,899,667, issued Feb. 13, 1990 and U.S. Pat. No. 4,976,205, issued Dec. 11, 1990, respectively.

FIELD OF THE INVENTION

The present invention relates to ironing boards, and more particularly, to a portable ironing board unit for mounting on a door and capable of being retracted when not in use.

BACKGROUND OF THE INVENTION

Every household has one or more ironing board units for ironing clothes and other household fabric items. The standard ironing board unit today is a free-standing model having scissor legs. When the legs are folded under the board, the ironing board unit may be stored in a closet, in the corner of a utility room or the like.

A second type of ironing board unit has found utility in the household and manufacturers have enjoyed reasonably good marketing success with it. This unit is mounted in a recess of a wall, or in a standard swinging door. One of the main advantages is that the wall mounted unit may be retracted into a stowed position and even during use does not interfere with the floor space below. By far, the most popular of these units utilizing a standard size ironing board is of the type shown in the Worley, et al. U.S. Pat. No. 1,868,185. This type of unit includes a full sized cabinet that is recessed into a standard wall between adjoining studs. In use, the door of the unit is opened and the ironing board folds down into a substantially horizontal position for ironing. Because of the full cabinet required and the need for a carpenter for installation, the cost of this type of unit is well above the cost of a standard floor mounted ironing board. Furthermore, many units of this style are fabricated of expensive wood work and trim, making the cost of a single unit even greater.

A similar approach is a permanently mounted ironing board unit adapted for fitting within a recess of a standard swinging door. The patent to Triller U.S. Pat. No. 1,766,154 is illustrative of this prior approach. The cost involved here also prevents this unit from being competitive with a standard, floor mounted ironing board. The requirement for heavy wooden components results in a door that is undesirably heavy and thus, uncomfortable to use.

The patent to Avidiya U.S. Pat. No. 3,170,417 represents an attempt to alleviate part of the weight problem but results in a door that has an open space when the ironing board is in the operative position. Also, in the unit of the type shown in Avidiya, the components are clearly not sturdy causing undesirable instability during your use and unsatisfactory service life. In a similar fashion, the Rasmussen U.S. Pat. No. 2,386,139 shows a downsized unit that is door mounted that can be used only for the lightest pressing jobs. The board interferes with normal use of the door and requires removal for storage against a wall or the like when not in use.

As a result of these shortcomings of the prior art, a need is identified for a full-sized ironing board unit for door mounting, but without the high cost attributable to wall/door mounted units of the prior art. In this specific targeted market area, there is no ironing board unit that has heretofore been developed.

OBJECTIVES OF THE INVENTION

Accordingly, it is a primary object of the present invention to provide an ironing board assembly for door mounting or the like having improved stability and serviceability.

It is another object of the present invention to provide a portable, lightweight ironing board unit that is engineered for low cost, easy installation and is marketable at a highly competitive price.

It is still another object of the present invention to provide an ironing board assembly fabricated of a simple mounting frame in combination with hanger brackets that are positioned over the top edge of the door and a pivotably mounted ironing board for retractable movement to a stored position.

It is still another object of the present invention to provide an ironing board assembly having simple component parts that may be fabricated in a highly efficient manner on automatic equipment, and which component parts provide for convenient operation, stability of the ironing board unit during use and exceptionally long service life.

Still another object of the present invention is to provide an ironing board assembly that can be used on a door and yet does not significantly detract from the operation of the door.

It is still another object of the present invention to provide a door mounted ironing board assembly that may be quickly and easily shifted between the operative and the retracted positions.

SUMMARY OF THE INVENTION

To achieve the foregoing and other objects, and in accordance with the purposes of the present invention as described herein, an improved ironing board assembly is provided including a mounting frame, an ironing board pivotally mounted on the frame for lowering to the ironing position and for retracting to the stored position, and a hanger bracket coupled to the frame for extending over the top edge of the door for mounting of the assembly. An optional swinging door or cover may be provided for the assembly.

In accordance with an important feature of the invention, the hanger bracket provides an efficient mounting for the assembly without modification of the door. In the preferred embodiment, a pair of unique hanger brackets are provided. Each bracket includes a U-shaped hook for engaging over the top edge of the door and a second hook extending in the opposite direction for receiving the mounting frame.

In the preferred embodiment, the mounting frame is fabricated of stock tubular metal with a round cross section. The second hook is generally semicircular to receive the frame. Preferably, the semicircular extent of the second hook is approximately 10° more than 180° (190°) to provide a snap action of the frame into the hook. A punch-in prong in the second hook adjacent the distal end of the hook fits in an aperture in the frame to rotably secure the parts together.

A coupler section between the first and second hooks forms the hanger bracket into an S-shape. The coupler section is patterned so as to provide a small included angle between the hooks. The mounting frame is thus pre-biased to hold snug against the door to minimize movement away from the door when the door is opened or closed.

The angle built into the coupler section is preferably approximately 6°. It has been found that this provides maximum holding action while at the same time preventing undesirable release of the hanger brackets from the top of the door.

A modification provides for the span of the first hook to be adjusted to accomodate different door thicknesses. A simple elongated slot and fastener connection is illustrated for this purpose.

In order to provide a high degree of stability to the board in the lowered, operative position, a U-shaped support brace is mounted adjacent the bottom of the frame. The brace pivots on integral pins at the lower ends of the legs and at least one of the legs is sufficiently flexible to allow limited lateral movement of that pin. A detent is provided for engagement with the flexible leg of the brace to hold the board in the retracted position.

In the preferred embodiment, the detent comprises a tab mounted on the ironing board frame that is positioned between the brace and the mounting frame. A cam portion extends into the path of the one leg providing a flexing of the leg when the board is retracted and snap action engagement for the board in the retracted position. When the board is ready to be lowered for use, a combined slight backward tilting movement of the board and lateral flexing of the one leg is all that is required. The dual movement prevents inadvertent release of the board.

The U-shaped support brace is guided along the underside of the ironing board and engages a pair of resilient stops mounted on the ironing board frame. Preferably, the stops are molded of nylon or similar plastic. The center section of the support brace is sufficiently wide to urge the legs against the base of the stop to assist in maintaining secure attachment to the frame.

The optional door or cover of the ironing board assembly of the present invention is preferably a low cost, vacuum formed piece of relatively thin, semi-rigid plastic. During vacuum forming, a peripheral flange is formed on the door. Upper and lower hinge assemblies are fixed to the mounting frame and include an elongated rod with a hook on the distal end. The hook engages the flange at the top and bottom of the door holding the door captive and permanently mounted for swinging action in a very efficient manner.

Each hinge assembly includes a mounting block for the hinge rod formed of a molded plastic. A retaining slot in the block receives the rod. For economy of manufacture, the blocks and hinge rods are interchangeable. Thus, the hinge assemblies can be mounted for either right or left hand swinging action of the door.

Since the mounting blocks extend outwardly from the frame, they advantageously may serve as spacers for the frame against the door. In addition, a pair of suction cups are mounted adjacent the spacers at the bottom of the frame. The suction cups extend outwardly from the frame past the spacers to insure firm seating engagement with the door. With the proper pre-biasing force built into the hanger brackets, and especially with the weight of the board in the extended operative position applying additional leverage to the frame, the ironing board assembly is held snugly in position with the spacers and the suction cups firmly seated on the door face.

BRIEF DESCRIPTION OF THE DRAWINGS

The accompanying drawings incorporated in and forming a part of the specification, illustrates several aspects of the present invention, and together with the description to explain the principles of the invention. In the drawings:

FIG. 1A is a perspective view of the ironing board assembly of FIG. 1 shown in position on a standard door (dashed line outline) and with the door of the assembly partially open at a 90° angle;

FIG. 1B is a front view of the unit with the door closed and the ironing board completely stored inside;

FIG. 5 is enlarged detailed view with parts broken away showing the ironing board frame retracted and held in position by the detent tab;

FIG. 6 shows the release action of the ironing board frame from the detent tab and the resilient stop for the U-shaped support brace;

FIG. 7 is a cross-sectional view taken in a longitudinal direction along the board and showing the guide means and resilient stop for the support brace;

FIG. 8 is a cross-sectional view taken along line 8—8 of FIG. 1 showing the upper hinge assembly including a mounting block engaging the mounting frame and a hinge rod for the door carried by the mounting block;

FIG. 9 is a cross-sectional view taken along line 9—9 of FIG. 8 and illustrating the curved mounting end of the pod within the mounting block;

FIG. 10 is a cross-sectional view of the lower hinge assembly taken along line 10—10 of FIG. 1;

FIG. 11 is a cross-sectional depiction similar to that shown in FIG. 9, taken along line 11—11 of FIG. 10, but showing the lower hinge assembly with the curved end of the rod within the mounting block; and FIG. 12 is a cross-sectional view taken along line 12—12 of FIG. 1 and showing the vacuum formed shell forming the door or cover of the assembly and with the mounting hooks illustrated extending through the peripheral flange.

Reference will now be made in detail to the present preferred embodiment of the invention, an example of which is illustrated in these drawings.

DETAILED DESCRIPTION OF THE INVENTION

Figure 1:
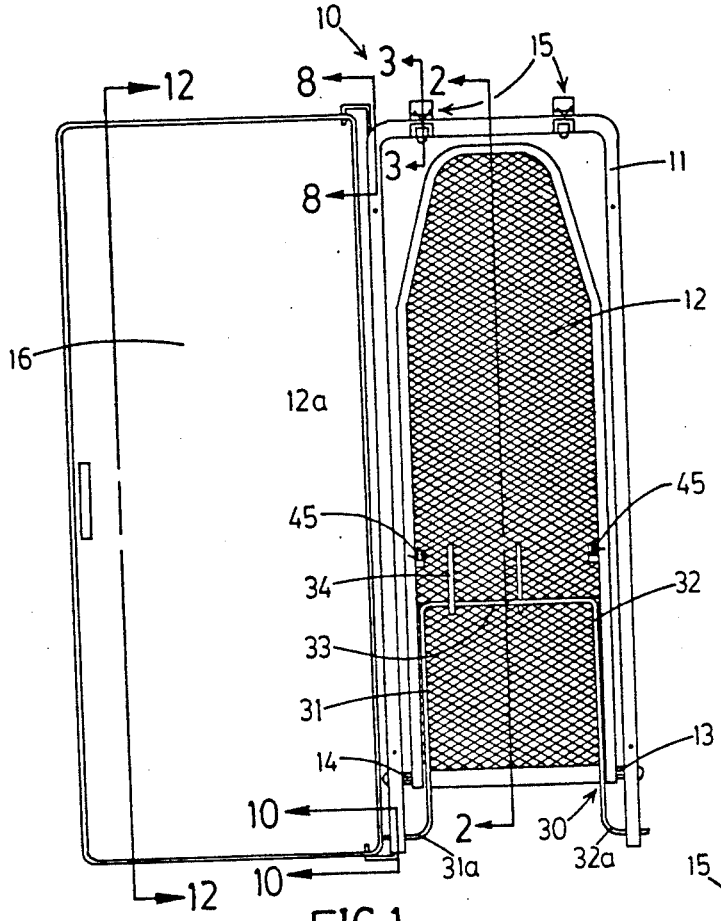
FIG. 1 is a front view of the ironing board assembly of the present invention with the board retracted and the optional door installed on the left side and fully open.

With reference now being made to FIGS. 1, 1A and 1B of the drawings, there is shown in these overall views, an improved ironing board assembly 10 incorporating the novel features of the present invention. As illustrated for purposes of full disclosure of the invention, the ironing board assembly includes a tubular frame 11 that is preferably of a circular cross-section and includes a pair of bends at the top to form an inverted U-shape. An ironing board 12 is pivotally mounted on pivot rods 13, 14 adjacent the bottom of the frame 11. A pair of hanger brackets 15 are secured to the top cross piece of the frame 11.

As best shown in FIG. 1A, the brackets extend over the top edge of a door D. While the door D is envisioned as a standard sized 6'8" inside door, it should be clear that other sized doors or door-like supports can be utilized in accordance with the broadest aspects of the present invention. Of course, in addition to swinging doors, in some instances, the door panel on which the assembly 10 is hung may be of the sliding door type, such as a sliding door with roller supported trucks engaging an overhead track. While use of the brackets is the preferred method of attachment, other methods, such as direct atachment by fasteners to the door or a wall, may be used in accordance with some of the broader aspects of the invention. The ironing board assembly 10 includes its own door or cover 16 that is mounted for either right or left-hand swinging movement, as will be discussed more in detail later.

Figure 3:
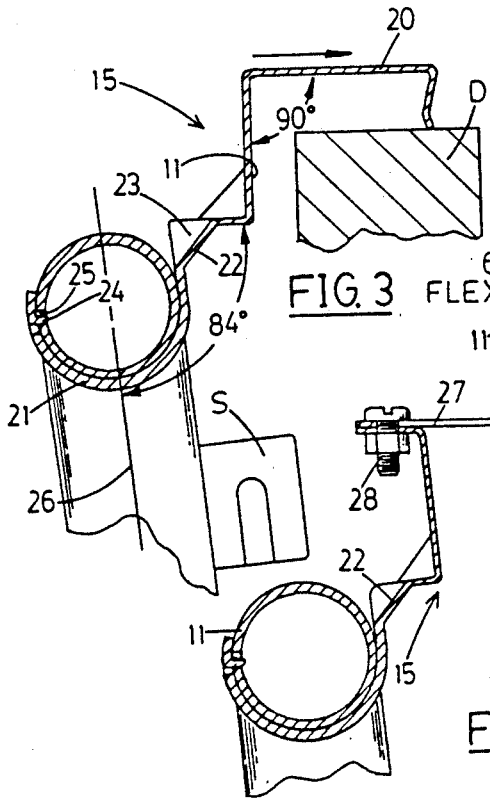
FIG. 3 is a cross-sectional view taken along line 3—3 of FIG. 1 showing the hanger bracket being positioned over the top edge of a door and with the pre-bias illustrated in the coupler section of the hanger bracket.
Figure 3A:
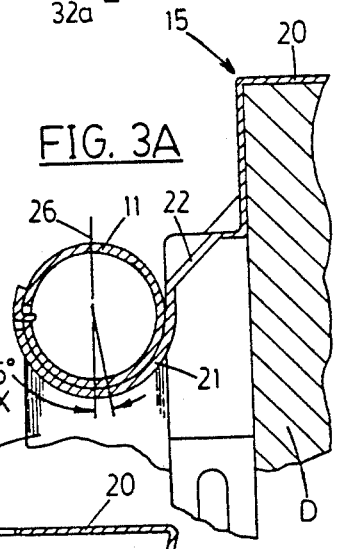
FIG. 3A is a cross-sectional view similar to FIG. 3 but with the hanger bracket in full engagement position on the door and with the ironing board assembly showing a pre-bias toward the door to maintain the assembly snug against the door.
Figure 4:
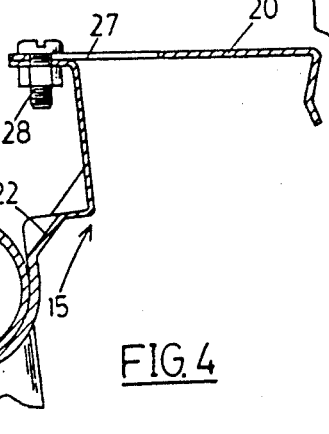
FIG. 4 is a cross-sectional view of a modified bracket wherein the span of the bracket is adjustable for accomodating different thicknesses of doors.

The bracket 15 is best shown in detail in FIGS. 3 and 3A and comprises a first or upper hook 20 that is U-shaped and inverted so as to be positionable along the top edge of the door. It will be realized that the preferred embodiment of the assembly 10 is portable and can easily be positioned on the door D by simply lifting and moving the hook 20 in the direction of the action arrow of FIG. 3. When the hook fully engages the top of the door, the assembly 10 is held snugly in position with spacer S biased against the door face, as shown in FIG. 3A, as will be discussed more in detail below.

The upper cross piece of the frame 11 is received in a second or lower hook of the hanger bracket 15, the second hook being designated by the reference numeral 21. The hook extends in the opposite direction from the first hook, and preferably embraces more than 180° (approximately 190°) of the tubular frame 11 so as to snap into position when the parts are assembled. A coupler section 22 connects the first and second hooks 20, 21 and may include reinforcing gussets 23. The coupler section 22 and the two hooks 20, 21 form an S-shape. The frame 11 is held securely to the second hook 21 by an integral locking prong 24 to prevent relative rotational movement. In the embodiment shown, the prong 24 engages a lanced aperture 25 in the cross piece and performs its function by extending in the direction opposite to the force tending to rotate the frame 11. In this manner, the locking arangement is relatively easy to fabricate, but at the same time is highly effective.

In the preferred embodiment shown and as further illustrated in FIG. 3A, the alignment of the coupler section 22 provides a small, included angle between the first and seconds hooks 20, 21. As presently determined, an 84° angle, which can be measured between the center axis 26 of the frame 11 and the coupler section 22, is preferred (see FIG. 3). This provides a substantially 6° flex upon rotation of the center axis 26 of the frame as the assembly 10 is mounted on the door D (compare FIGS. 3 and 3A). With the 6° flex of the hook 21, the frame 11 is firmly positioned and biased toward the door D. The spring memory in the coupler section 22 can thus be described as providing a pre-bias of the frame 11 toward the door D.

Figure 2:
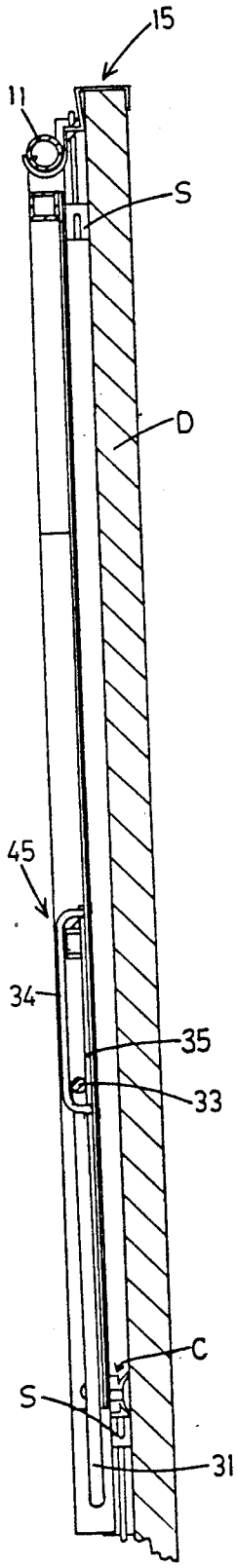
FIG. 2 is a cross-sectional view taken along line 2—2 of FIG. 1 showing the ironing board in the folded, stored position.

A mounting spacer S engages the face of the door at each of the top and bottom corners (see FIG. 2).

In addition, a pair of suction cup assemblies C are mounted adjacent the bottom two spacers (see FIGS. 2 and 10). As shown, the resilient cup portion 53 extends beyond the operative face of the spacer S so that it can fully engage the door D. As the frame 11 is biased toward the door, and especially with the board 12 in the lowered position, the cup portion 53 is pressed flat to form a holding vacuum with the door face. A flexible support portion 54 serves to back-up and position the cup portion 53 for reliable operation. The leverage of the board 12 advantageously increases the holding force, and as weight is added, such as during ironing, the tighter the holding force is.

As a result, the ironing board assembly 10 is maintained snug at all times, which is especially important for lateral stability during swinging movement of the door D. Furthermore, the force per unit area is relatively concentrated by the limited area of the cup assemblies C and the spacers S. This factor further assures that lateral sliding action across the face of the door is resisted by the vacuum force of the cups as well as the frictional force. As a result, the door can be operated without significant distraction or interference from the presence of the assembly 10.

If desired, the bracket 15 can be made adjustable by any suitable means, such as a slot 27 along the length of the first hook 20. A clamping nut and bolt combination 28 fixes the span of the bracket so that a snug fit with a particular door thickness can be assured. A good fit provides maximum effectiveness of the flex angle built into the coupler section 22.

In order to support the pivotal ironing board 12 in its substantially horizontal or operative position, a U-shaped support brace 30 is provided (see for example, FIG. 1A). This type of brace securely supports the board 12 so that virtually all ironing operations can be handled, from the lightest pressing operations to the heavier ironing chores involving large clothing and table linens. When the ironing board 12 is lowered to the operative position, as best shown in FIG. 1A, the U-shaped brace 30 extends outwardly at a suitable support angle. In the retracted position, the U-shaped brace 30 is positioned substantially parallel to the bottom of the board 12 (FIGS. 1 and 2).

The support brace includes two legs 31, 32 and a center section 33. A pair of guides, which can be in the form of shallow, U-shaped rods 34, 35 hold the center section 33 captive (see FIGS. 2 and 7) so that upon lowering or raising of the board 12, the brace 30 follows. The rod 35 that is in juxtaposition with the underside of the board 12, provides essentially point engagement with the center section 33 eliminating any substantial frictional drag as the board 12 is raised or lowered. This not only provides easier operation, but prevents deleterious rubbing and marring of the finish of the underside board surface.

At the lower ends of the legs 31, 32, the rod forming the brace is bent laterally to form integral pivot pins 31*a*, 32*a*. At least one leg 31 (see FIGS. 5 and 6) is sufficiently flexible to move inwardly under manual pressure, and the pivot pin 31*a* is free to slide within the mounting aperture of the frame 11. The sliding pin action is sufficent to a degree to allow the one leg 31 to perform an essential locking action for the board 12, as will be presently discussed.

The ironing board 12 includes a peripheral frame 12*a*, that is preferably of a square tubular cross-section (see FIGS. 5 and 6). The frame is positioned between the mounting frame 11 and the corresponding legs 31, 32 of the U-shaped brace 30. Adjacent the one leg 31 is a detent tab 40, preferably a molded plastic piece with mounting posts extending into undersized holes in the frame 12*a*. When the board 12 is in the retracted position, the detent tab engages or interferes with the leg 31, and thus securely holds the board 12 upright in the stored position (see FIGS. 1 and 5). However, when the one leg 31 is manually shifted in the lateral direction away from the detent tab or inwardly with respect to the board, the leg 31 moves free of the detent tab and the board 12 including the frame 12*a* can be lowered. In this specific regard, note the action arrows in FIG. 6 showing the inward flexing and then the outward relative movement of the leg 31 of the brace 30.

In accordance with a more limited aspect of this feature of the present invention, the detent tab 40 includes a cam portion 40*a* that extends into the interference relationship with the leg 31. As the ironing board 12 is raised to the retracted or storage position, the brace 30 follows the guide rod 34. As the board 12 reaches the near vertical position, the leg 31 engages the cam portion 40*a* and is cammed inwardly away from the frame 12*a* (note FIG. 6). The inward lateral movement caused by the camming action allows the leg 31 to move by snap action behind the detent tab 40. In the retained position, the cam portion 40*a* serves to securely hold the board in the upward stored position.

To release the board 12 for movement back to the operative position, the operator need simply to tilt the board 12 gently in the rear direction toward the door D, manually engage the leg 31 adjacent the pivot pin 31*a* and flex the leg 31 inwardly whereupon the board is allowed to move by gravity to the horizontal, operative position of FIG. 1A. Since a two-way movement is required for release, that is the board 12 manually tilted slightly back and the leg 31 laterally inwardly, a feature discouraging inadvertent release of the board 12 is provided.

When the ironing board 12 reaches the operative, substantially horizontal ironing position, as shown in FIG. 1A, there is a need for a stop means to intercept the support brace. In accordance with the present invention, a pair of resilient stops 45 are mounted on the inside edge of the board frame 12*a* (see FIGS. 1 and 1A). The support brace 30 is urged into engagement with the stops 45 at the ends of the center section because the guide rod 34 holds the brace captive and against the bottom of the board 12.

The preferred embodiment of the stop 45 includes a base 46 with a pair of attachment studs 47 force fitting into undersized apertures in the frame 12*a*. Since the guide rod 35 raises the center section 33 above the back surface of the board 12, the corner on each side of the brace 30 is efficiently guided into engagement with cross member 48 of the aligned stop 45. The base 46 is Y-shaped with chamfered edges 49 to guide the brace 30 into engagement. A reinforcing gusset 50 can be provided to strengthen the stop 45. As best shown in FIG. 1 and 1A, the center section 33 is sufficiently wide to urge the legs 31, 32 against the base 46 to assist the attachment studs in retaining their mounted position.

Advantageously, the stops 45 are molded as a single piece plastic, such as impact resistant nylon. When the support brace engages the plastic stops, shock is efficiently absorbed to not only prevent damage to the unit if the board 12 is inadvertently dropped, but also to obviate metal to metal noise that would otherwise occur with a metal stop. As with the remainder of the structure, the molded plastic stop provides for a sturdy and efficient structure, but at the same time is lightweight and low in cost in accordance with the objectives of the invention.

In accordance with another aspect of the present invention, the door or cover 16 is fabricated of a lightweight, inexpensive vacuum formed plastic. When the door is closed, as shown in FIG. 1B, the ironing board assembly provides a very clean, aesthetically pleasing appearance. Thus, the door 16 is believed to be a desirable optional feature. As best shown in FIG. 1A, in conjunction with FIG. 12, the door 16 includes a peripheral flange 16*a* that serves to extend around the frame 11 for maximum coverage when in the closed position.

The mounting of the door or cover 16 is by a unique hinge assembly 55, that can be effectively used for either the upper or lower hinge, and for either right or left-hand opening. The hinge assembly is fixed to the mounting frame 11 adjacent the top (FIG. 8) or adjacent the bottom (FIG. 10). Each hinge assembly includes an elongated rod 56 carried by the spacer S and extending substantially parallel to the frame 11. A hook 57 on the distal end of the rod 56 engages either the upper or lower flange 16*a* of the door 16 (see FIG. 12).

The spacer S forms a novel mounting block for the rod 56. It is formed of molded plastic and includes a retaining slot 59 to receive curved mounting end 60 of the rod 56. A cross slot 61 is provided adjacent one end of the spacer S so that when the curved mounting end 60 of the rod is pulled out of the block for removal of the rod 56, the hook 57 can be rotated and the hinge assembly 55 can be disassembled. With the reverse action, the rod 56 can be easily mounted by simple rotation in two planes and their movement of the rod 56 longitudinally along the spacer until the retaining position (FIGS. 9 and 11) is reached. In order to secure the mounting block 58 on the frame 11 and assure the proper orientation for either the upper or lower hinge, a pair of disparate mounting studs 62 are provided for a force fit into apertures (see FIGS. 8 and 10).

The opposed direction of the hooks 57 engaging the peripheral flange 16*a* tends to retain the door 16 in the proper centered position. A detent bump 63 may be provided on the curved mounting end of the rod 56 for force engagement within the slot 59 and effective retention action for the hinge rod 56.

In summary, it will now be realized that numerous benefits and advantages have been set forth with respect to the improved ironing board assembly 10. A mounting frame 11 is easily fabricated of lightweight metal tubing, and in combination with the unique hanger brackets 15, support the ironing board assembly 10 in a very efficient manner on a door D. The ironing board 12 is pivoted for retraction into the frame 11 and a vacuum formed door 16 may be provided to cover the entire unit if desired.

The hanger bracket 15 is uniquely designed to provide a pre-bias to the frame 11 so that the assembly is held in snug relationship to the door D during opening or closing. The vacuum cup assemblies C/spacers S serve to concentrate the holding force, and thus further assure against lateral shifting on the door. A U-shaped support brace 30 holds the board in the secure horizontal position while ironing. A resilient stop 45 provides secure positioning in the operative position while absorbing deleterious shock. A detent tab 40 provides a two-way interference relationship with one leg 31 of the brace 30 serving to retain the board 12 in the retracted position. The door or cover 16 for the ironing board unit is securely positioned by interchangeable hinge assemblies 55 formed in combination with the spacers S.

The foregoing description of a prefered embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. An ironing board assembly for standard door mounting or the like comprising:

a portable mounting frame;

an ironing board having a normal ironing surface and length and being pivotally mounted on said frame for lowering to an operative, substantially horizontal position at normal ironing height and for retracting to a storage, substantially vertical position;

bracket means attached to said assembly adjacent the top of the frame adapted for engaging the top edge of the door; said bracket means including at least one inverted hook hanging over the top edge of the door; and raised friction means on said mounting frame and spaced apart facing said door having sufficient frictional properties for holding engagement with the face of said door to resist lateral shifting during ironing.

2. An ironing board assembly for standard door mounting or the like comprising:

an elongated U-shaped tubular mounting frame;

an ironing board having a normal ironing surface and length and being pivotally mounted on said frame for lowering to an operative, substantially horizontal position at normal ironing height and for retracting to a storage, substantially vertical position; and mounting means on the frame adapted for engaging the door for holding engagement with the face of said door to resist lateral shifting during ironing.

3. The ironing board assembly of claim 2 wherein said mounting frame is inverted and the ironing board extends substantially along the length of said frame in the storage, substantially vertical position adjacent the frame; and said frame having an open part of the U at the bottom, said ironing board being pivotally attached to the frame across the open bottom part.

4. The ironing board assembly for standard door mounting or the like comprising:

a mounting frame;

an ironing board pivotally mounted on said frame for lowering to an operative, substantially horizontal position at normal ironing height and for retracting to a storage substantially vertical position adjacent the frame;

an upper and lower hinge assembly connected to the mounting frame;

mounting block means on said frame extending toward and engaging the adjacent face of the door to form a spacer for the frame from the door; and a cover pivotally mounted by said hinge assemblies, the cover having an open position to swing free of the board for movement of the board to the operative position and a closed position to swing over the board for substantially covering the ironing board assembly in the storage position.

5. An ironing board assembly for standard door mounting or the like comprising:

a portable mounting frame;

an ironing board having a normal ironing surface and length and being pivotally mounted on said frame for lowering to an operative, substantially horizontal position at normal ironing height and for retracting to a storage, substantially vertical position;

bracket means attached to said assembly adjacent the top of the frame adapted for engaging the top edge of the door; said bracket means including at least one inverted hook hanging over the top edge of the door; and holding means on said mounting frame and facing said door having sufficient holding properties for holding engagement with the face of said door to resist lateral shifting during ironing.

6. An ironing board assembly for standard door mounting or the like comprising:

a portable mounting frame;

an ironing board having a normal ironing surface and length and being pivotally mounted on said frame for lowering to an operative, substantially horizontal position at normal ironing height and for retracting to a storage, substantially vertical position;

bracket means attached to said assembly adjacent the top of the frame adapted for engaging the top edge of the door; said bracket means including at least one inverted hook hanging over the top edge of the door; and means attached to said assembly for biasing said mounting frame towards said door, whereby said frame tends to be maintained snug against the door during ironing.

* * * * *